US006861631B2

(12) United States Patent
Hahm et al.

(10) Patent No.: US 6,861,631 B2
(45) Date of Patent: Mar. 1, 2005

(54) MICROWAVE OVEN HAVING A STEAMING PLATE

(75) Inventors: Kyung-Hee Hahm, Seoul (KR); Tae-Soo Kim, Seoul (KR); Young-Won Cho, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/412,220

(22) Filed: Apr. 14, 2003

(65) Prior Publication Data

US 2004/0050840 A1 Mar. 18, 2004

(30) Foreign Application Priority Data

Sep. 14, 2002 (KR) ..... 2002-55992

(51) Int. Cl.[7] ..... H05B 6/72; H05B 6/80

(52) U.S. Cl. ..... 219/682; 219/756; 219/731; 219/746; 99/DIG. 14

(58) Field of Search ..... 219/682, 756, 219/746, 748, 401, 731; 99/DIG. 14, 451, 468

(56) References Cited

U.S. PATENT DOCUMENTS 4,481,392 A * 11/1984 Nibbe et al. ..... 219/729
6,040,564 A * 3/2000 Ueda et al. ..... 219/682

FOREIGN PATENT DOCUMENTS

FR 2670272 * 6/1992 ..... 219/682
JP 1-255186 * 10/1989 ..... 219/746

OTHER PUBLICATIONS

Patent Abstracts of Japan, Pub. No. 08–135979, May 31, 1996 for Application No. 06–273635, filed Aug. 11, 1994.

* cited by examiner

*Primary Examiner*—Philip H. Leung
(74) *Attorney, Agent, or Firm*—Staas & Halsey LLP

(57) ABSTRACT

A microwave oven which has a simple structure, and steams food placed in a cooking cavity without having a separate steaming container. The microwave oven includes the cooking cavity provided in a cabinet, a magnetron provided outside the cooking cavity to irradiate microwaves into the cooking cavity, and a microwave inlet hole formed on a predetermined portion of the cooking cavity to irradiate the microwaves from the magnetron into the cooking cavity. A steaming plate is provided in the cooking cavity so as to partition the cooking cavity into upper and lower sections, and blocks the microwaves and allows water vapor to pass therethrough. The microwave inlet hole communicates with a bottom of the steaming plate provided in the cooking cavity.

23 Claims, 4 Drawing Sheets

MICROWAVE OVEN HAVING A STEAMING PLATE

CROSS-REFERENCE TO RELATED APPLICATIONS

This application claims the benefit of Korean Application No. 2002-55992, filed Sep. 14, 2002, in the Korean Intellectual Property Office, the disclosure of which is incorporated herein by reference.

BACKGROUND OF THE INVENTION

1. Field of the Invention

The present invention relates, in general, to microwave ovens and, more particularly, to a microwave oven which has a simple structure, and steams food in a cooking cavity without having a separate steaming container.

2. Description of the Related Art

As is well known to those skilled in the art, a microwave oven is an appliance which cooks, using microwaves, food placed in a cooking cavity of the microwave oven. That is, when microwaves from a magnetron irradiate the cooking cavity and cause an arrangement of molecules of moisture laden in the food to be repeatedly vibrated, frictional heat is generated within the food and cooks the food.

As shown in FIG. 1, the conventional microwave oven includes a cabinet 1 which defines an appearance of the microwave oven. The cabinet 1 is partitioned into a cooking cavity 2 and a machine room 3. A door (not shown) is hinged to a front of the cabinet 1 to selectively open or close the cooking cavity 2. A magnetron 3*a* and a high-voltage transformer 3*b* are installed in the machine room 3. The magnetron 3*a* irradiates microwaves into the cooking cavity 2. The high-voltage transformer 3*b* applies high voltage to the magnetron 3*a*. A cooking tray 2*a* is provided in the cooking cavity 2 so as to be rotated during an operation of the microwave oven.

After the food is placed on the cooking tray 2*a* and the door is closed, the microwave oven is operated. At this time, the food placed in the cooking cavity 2 is cooked by microwaves from the magnetron 3*a* to irradiate in the cooking cavity 2.

However, the conventional microwave oven is designed such that the food placed in the cooking cavity 2 is cooked through only a microwave-heating operation, so that a steaming container must be additionally installed in the cooking cavity 2 so as to steam the food placed in the cooking cavity 2, thus complicating a use of the microwave oven and causing inconvenience to a user.

SUMMARY OF THE INVENTION

Accordingly, it is an aspect of the present invention to provide a microwave oven which is capable of steaming food placed in a cooking cavity, without having a separate steaming container, by adding a simple structure to the microwave oven.

Additional aspects and advantages of the invention will be set forth in part in the description which follows and, in part, will be obvious from the description, or may be learned by practice of the invention.

The foregoing and other aspects are achieved by providing a microwave oven, including a cooking cavity provided in a cabinet, a magnetron provided outside the cooking cavity to irradiate microwaves into the cooking cavity, and a microwave inlet hole formed on a predetermined portion of the cooking cavity to supply the microwaves irradiated from the magnetron into the cooking cavity, wherein a steaming plate is provided in the cooking cavity so as to partition the cooking cavity into upper and lower sections, the steaming plate blocking the microwaves and allowing water vapor to pass therethrough, and the microwave inlet hole communicating with (for example, disposed in the lower section of the cooking cavity) a bottom of the steaming plate provided in the cooking cavity.

The steaming plate is made of a microwave blocking material, and a plurality of vapor passing holes of a predetermined size are formed on the steaming plate to block the microwaves and allow the water vapor to pass therethrough.

The steaming plate is removably mounted in the cooking cavity.

Further, a support is provided on each sidewall of the cooking cavity, the support being inwardly projected from the sidewall of the cooking cavity such that each side edge of the steaming plate is supported by the support.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
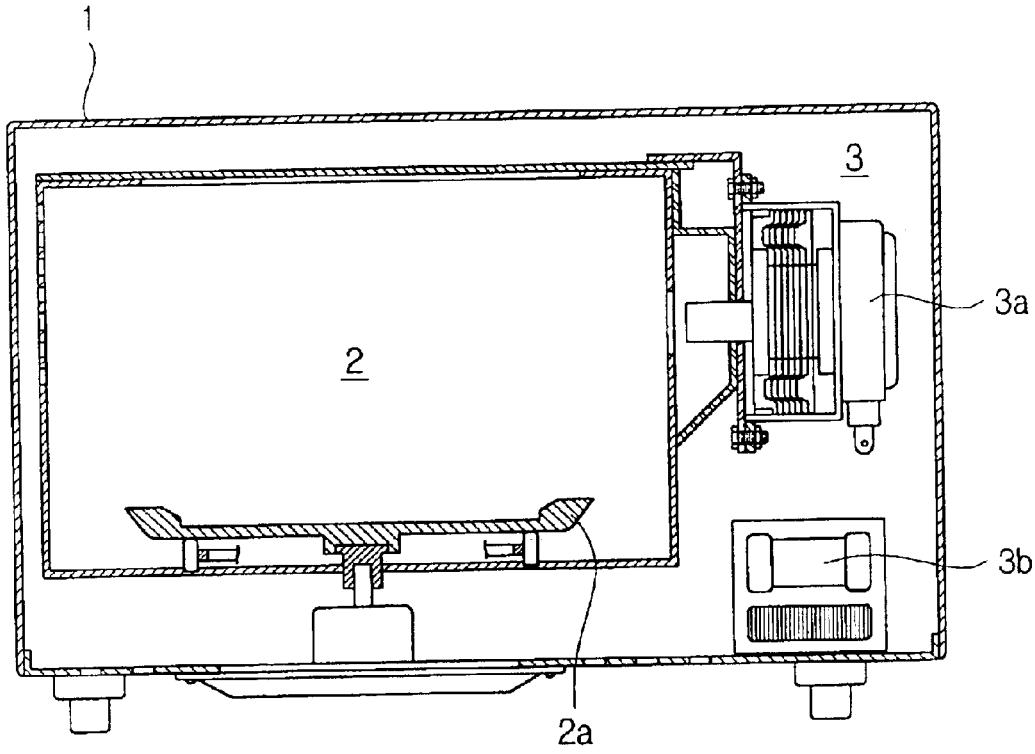
FIG. 1 (Prior Art)
FIG. 1 is a sectional view showing a conventional microwave oven.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

Figure 2:
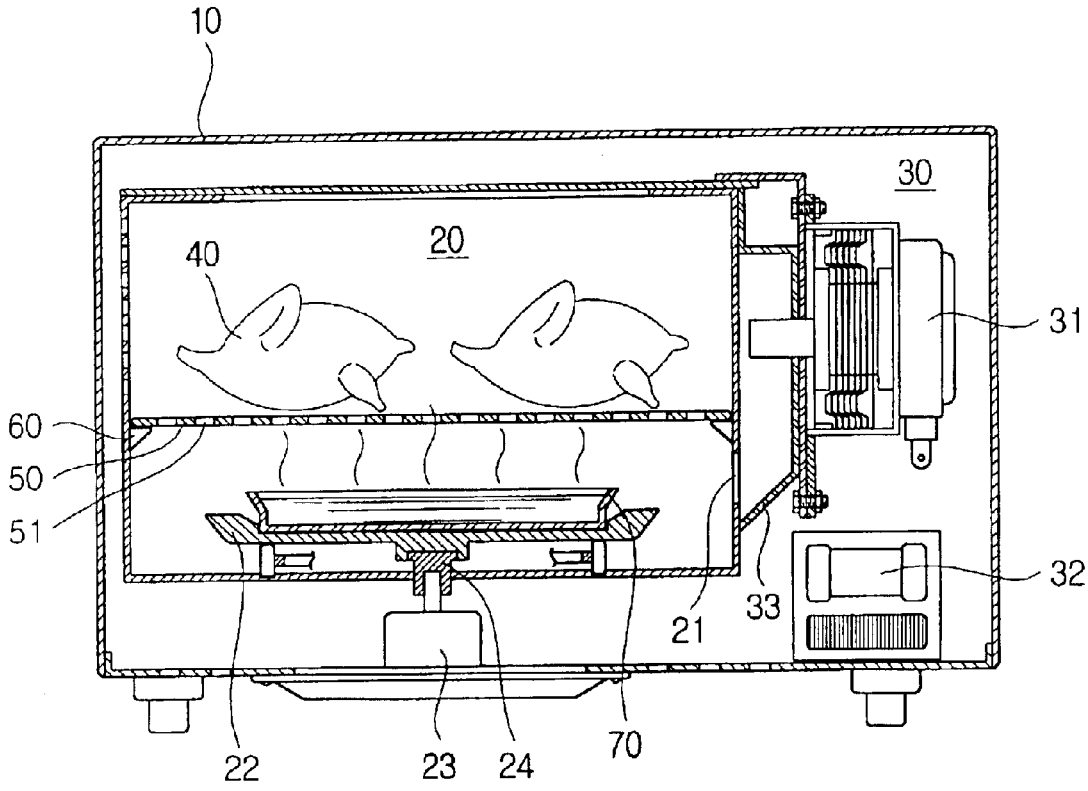
FIG. 2 is a sectional view of a microwave oven according to an embodiment of the present invention, with a steaming plate installed in a cooking cavity.

The microwave oven of an embodiment of the present invention cooks, using microwaves, food placed in a cooking cavity of the microwave oven. That is, when the microwaves from the magnetron irradiate the cooking cavity of the microwave oven and cause molecules of moisture laden in the food to vibrate, frictional heat is generated within the food and cooks the food. As shown in FIG. 2, the microwave oven includes a cabinet 10 which defines an appearance of the microwave oven. The cabinet 10 is partitioned into a cooking cavity 20 and a machine room 30. The cooking cavity 20 is used to cook the food. The machine room 30 contains several electrical devices.

A door (not shown) is hinged to a front of the cabinet 10 to selectively open or close the cooking cavity 20. A control panel (not shown) is mounted to the cabinet 10 in front of the machine room 30, and is provided with several control buttons.

The machine room 30 contains several electrical devices, including a magnetron 31 and a high-voltage transformer 32, to irradiate microwaves into the cooking cavity 20. The magnetron 31 irradiates the microwaves into the cooking cavity 20 and the high-voltage transformer 32 applies high voltage to the magnetron 31. A wave guide 33 is interposed between the magnetron 31 and the cooking cavity 20 to guide the microwaves from the magnetron 31 into the cooking cavity 20. A microwave inlet hole 21 is formed on a predetermined portion of the cooking cavity 20 to supply the microwaves from the wave guide 33 into the cooking cavity 20.

A disc-shaped cooking tray 22 is provided on a bottom of the cooking cavity 20 so as to be rotated during an operation of the microwave oven. A drive motor 23 is installed in a space between the bottom of the cooking cavity 20 and a bottom of the cabinet 10 to rotate the disc-shaped cooking tray 22. A coupler 24 is provided between the drive motor 23 and the disc-shaped cooking tray 22. To transmit a driving force of the drive motor 23 to the disc-shaped cooking tray 22, the coupler 24 is connected to a rotating shaft of the drive motor 23 and passes through the bottom of the cooking cavity 20 to be connected to a bottom of the disc-shaped cooking tray 22.

After food 40 is placed on the disc-shaped cooking tray 22 of the microwave oven constructed in this way, the microwave oven is operated. At this time, the microwaves from the magnetron 31 irradiate the cooking cavity 20 to cook the food 40 placed on the disc-shaped cooking tray 22.

Further, the microwave oven allows the food 40 placed in the cooking cavity 20 to be steamed without a steaming container. A construction of the microwave oven which allows the food 40 to be steamed without the steaming container will be described in the following in detail.

The microwave oven is provided with a steaming plate 50. The steaming plate 50 partitions the cooking cavity 20 into upper and lower sections. The steaming plate 50 is designed to block microwaves and allow water vapor to pass therethrough. The microwave inlet hole 21 through which the microwaves are supplied into the cooking cavity 20, is provided at a position on a sidewall of the cooking cavity 20 between the machine room 30 and the lower section of the cooking cavity 20 to communicate with the cooking cavity 20 under the steaming plate 50.

To place the steaming plate 50, which is of a rectangular shape, in the cooking cavity 20, a rail-shaped support 60 is provided on each sidewall of the cooking cavity 20. Each rail-shaped support 60 is inwardly projected from a respective sidewall of the cooking cavity 20 such that each side edge of the steaming plate 50 is supported by the rail-shaped support 60. Thus, the steaming plate 50 is removably installed in the cooking cavity 20 by the rail-shaped supports 60.

Figure 3:
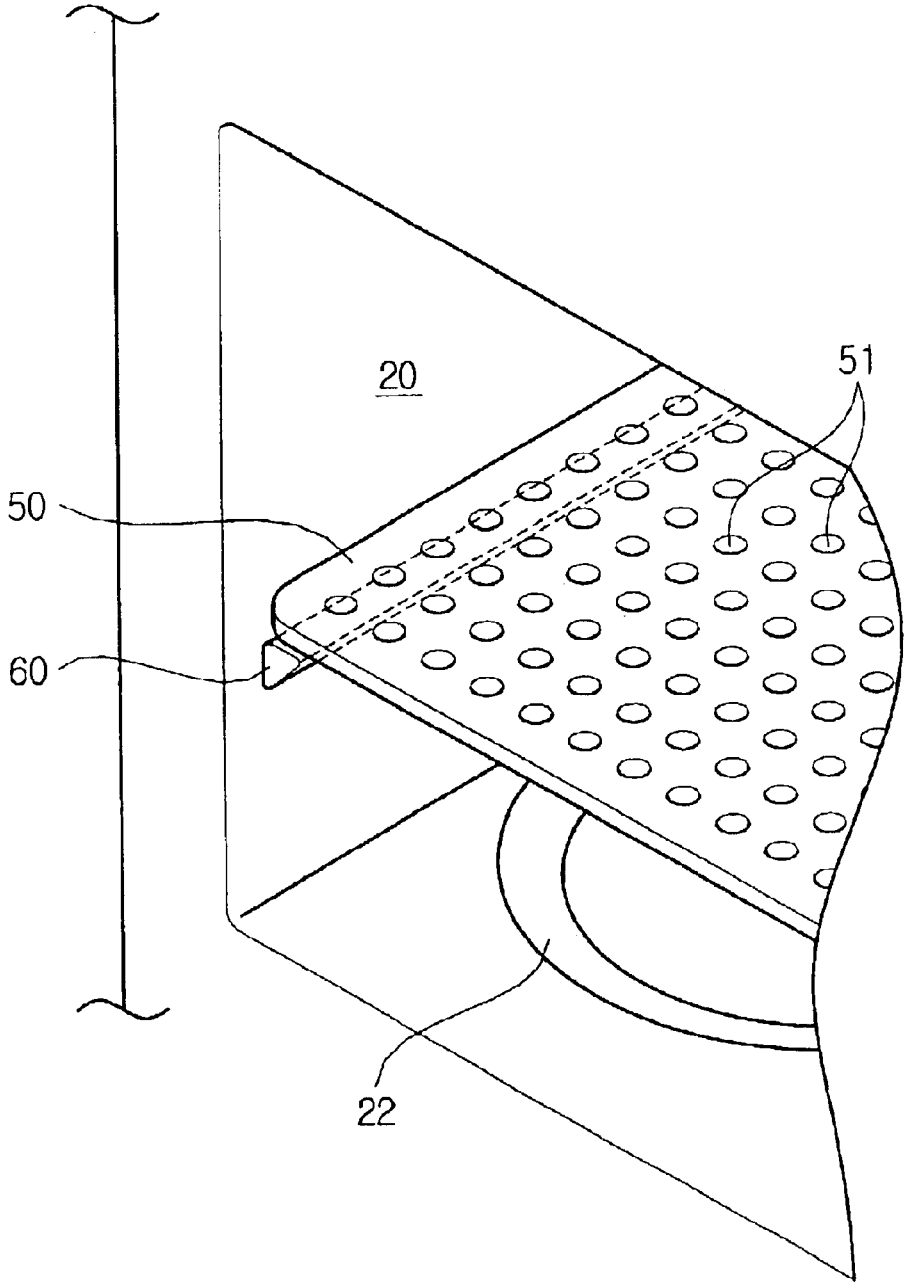
FIG. 3 is a partial perspective view of a steaming plate shown in FIG. 2.

The steaming plate 50 is made of a microwave blocking material to block the microwaves and allow the water vapor to pass therethrough. As shown in FIG. 3, a streaming plate with a plurality of vapor passing holes 51 of a predetermined size are formed throughout the steaming plate 50 to block the microwaves and allow the water vapor to pass therethrough.

First, the food 40 is placed on the steaming plate 50 and a water container 70 is placed on the disc-shaped cooking tray 22 under the steaming plate 50. When the microwave oven is operated in such a state, water contained in the water container 70 is heated by the microwaves irradiated into the cooking cavity 20 under the steaming plate 50 through the microwave inlet hole 21 to generate the water vapor. The water vapor is transmitted to the food 40 placed on the steaming plate 50 through the vapor passing holes 51, so that the food 40 is steamed. In this case, the microwaves serve to heat the water contained in the water container 70 which then passes through the vapor passing holes 51, but the microwaves are not directly transmitted to the upper section of the cooking cavity 20 which is above the steaming plate 50. Thus, the food 40 placed on the steaming plate 50 is cooked by only the water vapor. The water container 70 may be made of a microwave transmitting material, such as glass, plastic and ceramic.

The microwave oven allows the food placed in the cooking cavity 20 to be steamed without a steaming container by providing a simple structure, that is, the steaming plate 50, thus achieving various functions of the microwave oven, and thereby reducing the cost of the microwave oven by eliminating the steaming container.

A process of cooking the food 40 using the microwave oven according to the embodiment of the present invention will be described in the following, in detail.

Figure 4:
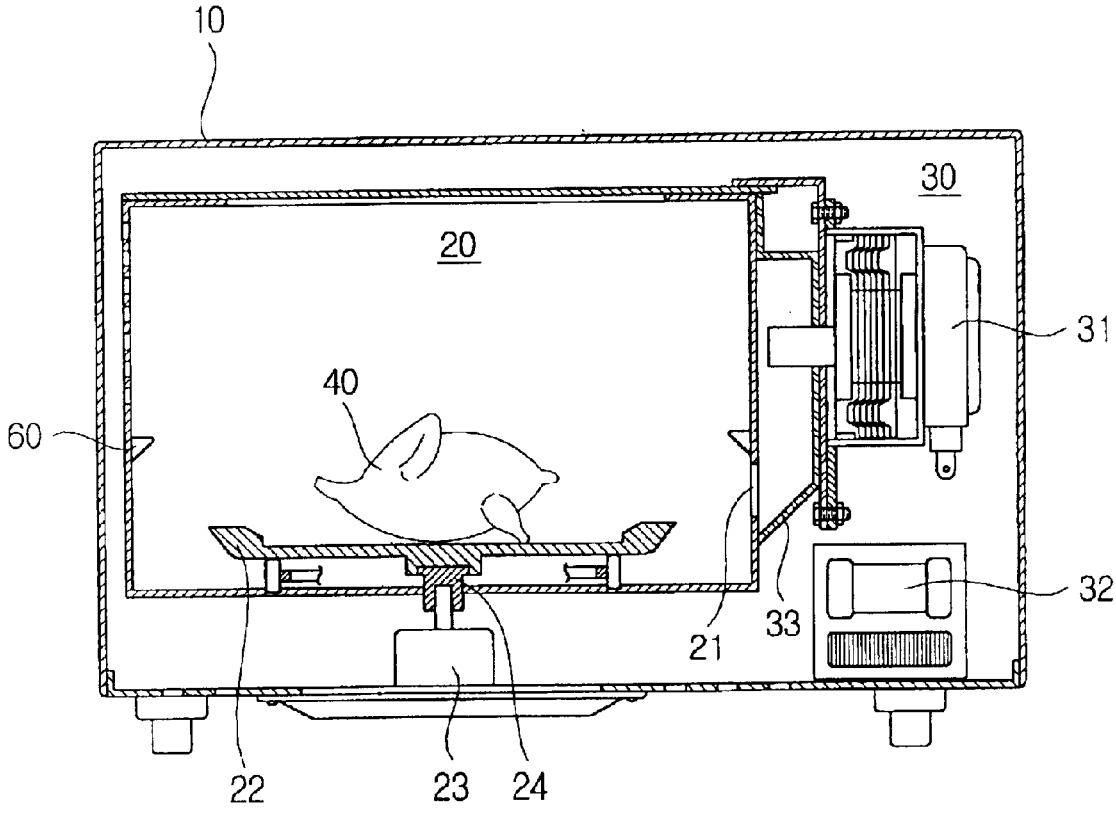
FIG. 4 is a sectional view showing the microwave oven of the embodiment of the present invention, with the steaming plate removed from the cooking cavity.

When the food 40 placed in the cooking cavity 20 is desired to be cooked through a microwave-heating operation, as shown in FIG. 4, the steaming plate 50 is removed from the cooking cavity 20. After the food 40 to be cooked is placed on the disc-shaped cooking tray 22, the microwave oven is operated. At this time, microwaves from the magnetron 31 directly irradiate the food 40 placed on the disc-shaped cooking tray 22, so that the food 40 is cooked through the microwave-heating operation.

Meanwhile, when the food 40 placed in the cooking cavity 20 is desired to be steamed, as shown in FIG. 2, the steaming plate 50 is installed in the cooking cavity 20 such that respective opposite side edges of the steaming plate 50 are supported on respective rail shaped supports 60. After the water container 70 is placed on the disc-shaped cooking tray 22 under the steaming plate 50, the food 40 is placed on the steaming plate 50 and the microwave oven is operated. At this time, the water, which is contained in the water container 70 and heated by the microwaves irradiated from the magnetron 31, evaporates to generate the water vapor. The water vapor is transmitted to the food 40 through the vapor passing holes 51 of the steaming plate 50 to steam the food 40.

As is apparent from the above description, a microwave oven is provided which allows food placed in a cooking cavity to be steamed without having a separate steaming container by providing a simple structure, that is, a steaming plate, thus achieving various functions of the microwave oven, and thereby reducing the cost of the microwave oven by eliminating the steaming container.

Although a preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A microwave oven including a cabinet, comprising:

a cooking cavity provided in the cabinet;

a magnetron provided outside the cooking cavity to irradiate microwaves into the cooking cavity;

a microwave inlet hole formed at a predetermined portion of the cooking cavity to supply the microwaves irradiated from the magnetron into the cooking cavity; and a steaming plate provided in the cooking cavity so as to partition the cooking cavity into upper and lower sections, the steaming plate blocking the microwaves and allowing water vapor to pass therethrough, and the microwave inlet hole is disposed in one of the upper section and the lower section of the cooking cavity.

2. The microwave oven according to claim 1, wherein the steaming plate is made of a microwave blocking material and comprises:

a plurality of vapor passing holes of a predetermined size formed in the steaming plate, so that the steam plate blocks the microwaves and allows the water vapor to pass therethrough.

3. The microwave oven according to claim 1, wherein the steaming plate is removably mounted in the cooking cavity.

4. The microwave oven according to claim 3, wherein the cooking cavity has sidewalls, and a support provided on each respective sidewall of the cooking cavity, said support being inwardly projected from each respective sidewall of the cooking cavity such that each side edge of the steaming plate is supported on a respective support.

5. A microwave oven including a cabinet having a cooking cavity and magnetron, respectively, disposed therein, the magnetron irradiating microwaves into the cooking cavity, and an inlet hole to supply the microwaves from the magnetron into the cooking cavity, comprising:

a steaming plate provided in the cooking cavity so as to partition the cooking cavity into first and second sections and positioned to block the microwaves which are supplied by the inlet hole into the first section and to allow water vapor to pass therethrough.

6. The microwave oven according to claim 5, wherein the steaming plate is made of a microwave blocking material and comprises:

a plurality of vapor passing holes of a predetermined size formed on the steaming plate, so that the steam plate blocks the microwaves and allows the water vapor to pass therethrough.

7. The microwave oven according to claim 5, further comprising:

a water container disposed in the first section of the cooking cavity to store water.

8. The microwave oven according to claim 7, wherein the water container is made of a microwave transmitting material.

9. The microwave oven according to claim 7, wherein the water container is made of one of glass, plastic and ceramic.

10. The microwave oven according to claim 5, wherein steam is generated when the microwaves irradiate the first section of the cooking cavity, the steam passing through the steaming plate to cook food placed on the steaming plate in the second section.

11. The microwave oven according to claim 5, wherein the steaming plate is removably mounted in the cooking cavity.

12. The microwave oven according to claim 5, wherein the inlet hole is positioned adjacent the first section and is positioned spaced apart from the second section.

13. The microwave oven according to claim 5, wherein the steaming plate prevents the microwaves from irradiating the second section which is spaced apart from the inlet hole, when the steaming plate is mounted in the cooking cavity.

14. The microwave oven according to claim 5, wherein the first and second sections are lower and upper sections of the cooking cavity, respectively.

15. The microwave oven according to claim 5, wherein the steaming plate is of a rectangular shape.

16. The microwave oven according to claim 5, wherein:

the cooking cavity has sidewalls, the sidewalls comprising supports inwardly projected from respective sidewalls; and the steaming plate comprising side edges corresponding to the supports of the sidewalls such that the steaming plate is supported at the side edges by the corresponding supports.

17. A microwave oven including a cabinet having a cooking cavity and magnetron, respectively, disposed therein, the magnetron irradiating microwaves into the cooking cavity, comprising:

an inlet hole positioned to supply the microwaves from the magnetron into a first section of the cooking cavity; and a steaming plate provided in the cooking cavity to block the microwaves which are supplied by the inlet hole into the first section of the cooking cavity and to allow water vapor to pass therethrough.

18. The microwave oven according to claim 17, wherein the inlet hole is positioned at a lower portion of the cooking cavity.

19. A cooking apparatus including a cabinet having a cooking cavity and magnetron, respectively, disposed therein, the magnetron irradiating microwaves into the cooking cavity, and an inlet hole to supply the microwaves from the magnetron into the cooking cavity, comprising:

a steaming plate removably provided in the cooking cavity so as to separate the cooking cavity into first and second sections, the steaming plate positioned to block the microwaves supplied by the inlet hole to the first section and to allow water vapor to pass therethrough, wherein the cooking apparatus operates as a microwave oven when the steaming plate is removed and the cooking apparatus operates as a steaming unit when the steaming plate is mounted in the cooking cavity.

20. A cooking apparatus including a cabinet having a cooking cavity and magnetron, respectively, disposed therein, the magnetron irradiating microwaves into the cooking cavity, and an inlet hole to supply the microwaves from the magnetron into the cooking cavity, comprising:

a steaming plate removably provided in the cooking cavity so as to partition the cooking cavity into first and second sections, the steaming plate positioned to block the microwaves supplied by the inlet hole to the first section and to allow water vapor to pass therethrough, wherein food placed in the cooking cavity is directly irradiated by microwaves when the steaming plate is removed and the food placed on the steaming plate, when the steaming plate is installed in the cooking cavity, is steamed by water irradiated in the first section.

21. A cooking apparatus including a cabinet having a cooking cavity and magnetron, respectively, disposed therein, the magnetron irradiating microwaves into the cooking cavity, and an inlet hole to supply the microwaves from the magnetron into the cooking cavity, comprising:

a plate removably mounted in the cooking cavity so as to partition the cooking cavity into first and second sections, the plate positioned to block the microwaves which are supplied by the inlet hole are supplied into the first section so as not to be supplied to the second section, wherein the microwaves supplied into the first section are concentrated to cook food placed in the first section faster, when the plate is mounted in the cooking cavity, than when the plate is removed from the cooking cavity.

22. A method of cooking using a microwave oven including a cabinet having a cooking cavity and magnetron, respectively, disposed therein, the magnetron irradiating microwaves into the cooking cavity, and an inlet hole to supply the microwaves from the magnetron into the cooking cavity, comprising:

removably partitioning the cooking cavity into first and second sections so as to block the microwaves in the second section and to allow a passage of water vapor;

supplying microwaves to the first section of the cooking cavity; and steaming food in the second section of the cooking cavity by the microwaves irradiating water in the first section.

23. A method of cooking using a microwave oven including a cabinet having a cooking cavity and magnetron, respectively, disposed therein, the magnetron irradiating microwaves into the cooking cavity, and an inlet hole to supply the microwaves from the magnetron into the cooking cavity, a steaming plate removably mounted in the cooking cavity to partition the cooking cavity into first and second sections and positioned to block the microwaves supplied by the inlet hole into the first section and to allow water vapor to pass therethrough, comprising:

cooking food placed in the cooking cavity by a direct microwave operation when the steaming plate is removed from the cooking cavity; and cooking the food placed on the steaming plate by a steaming operation when the steaming plate is mounted in the cooking cavity.

* * * * *